US008720791B2

(12) United States Patent
Slingsby et al.

(10) Patent No.: US 8,720,791 B2
(45) Date of Patent: May 13, 2014

(54) UTILITY-DRIVEN ENERGY-LOAD MANAGEMENT WITH ADAPTIVE FAN CONTROL DURING LOAD-CONTROL EVENTS

(75) Inventors: Karl A. Slingsby, Minneapolis, MN (US); Roger W. Rognli, Otsego, MN (US)

(73) Assignee: Cooper Technologies Company, Houston, TX (US)

( * ) Notice: Subject to any disclaimer, the term of this patent is extended or adjusted under 35 U.S.C. 154(b) by 914 days.

(21) Appl. No.: 12/870,097

(22) Filed: Aug. 27, 2010

(65) Prior Publication Data

US 2012/0048952 A1 Mar. 1, 2012

Related U.S. Application Data

(60) Provisional application No. 61/402,230, filed on Aug. 26, 2010.

(51) Int. Cl.
*F24F 7/00* (2006.01)

(52) U.S. Cl.
USPC ..... 236/49.3; 62/161

(58) Field of Classification Search
USPC ..... 236/49.3, 51; 62/161–164; 700/276; 340/870.16, 870.17
See application file for complete search history.

(56) References Cited

U.S. PATENT DOCUMENTS

| | | | | |
|---|---|---|---|---|
| 4,345,162 | A | 8/1982 | Hammer et al. | |
| 4,382,544 | A | 5/1983 | Stewart | |
| 7,242,114 | B1 | 7/2007 | Cannon et al. | |
| 7,528,503 | B2 | 5/2009 | Rognli et al. | |
| 7,595,567 | B1 | 9/2009 | Cannon et al. | |
| 7,702,424 | B2 | 4/2010 | Cannon et al. | |
| 8,474,279 | B2 * | 7/2013 | Besore et al. | 62/157 |
| 2002/0191946 | A1 * | 12/2002 | McDonald et al. | 385/147 |
| 2005/0043907 | A1 | 2/2005 | Eckel et al. | |
| 2006/0105697 | A1 | 5/2006 | Aronstam et al. | |
| 2010/0070091 | A1 * | 3/2010 | Watson et al. | 700/278 |
| 2010/0106305 | A1 * | 4/2010 | Pavlak et al. | 700/276 |
| 2010/0163633 | A1 | 7/2010 | Barrett et al. | |
| 2010/0179707 | A1 | 7/2010 | Cannon et al. | |

FOREIGN PATENT DOCUMENTS

EP 1826041 A1 8/2007

OTHER PUBLICATIONS

PCT Patent Application No. PCT/US2010/046911; filed Aug. 27, 2010; Applicant Cooper Technologies Company et al.; International Search Report dated Sep. 5, 2011.

PCT Patent Application No. PCT/US2010/046911; filed Aug. 27, 2010; Applicant Cooper Technologies Company et al.; Written Opinion dated Sep. 5, 2011.

* cited by examiner

*Primary Examiner* — Marc Norman
(74) *Attorney, Agent, or Firm* — Patterson Thuente Pedersen, P.A.

(57) ABSTRACT

An adaptive-fan-control (AFC) communicating thermostat for controlling an electrical load and controlling an HVAC circulation fan during a load control event. The thermostat interrupts and overrides an occupant-selected fan setting of the thermostat. The AFC communicating thermostat includes a controller in communication with a temperature sensor and the occupant-selectable fan control.

33 Claims, 2 Drawing Sheets

UTILITY-DRIVEN ENERGY-LOAD MANAGEMENT WITH ADAPTIVE FAN CONTROL DURING LOAD-CONTROL EVENTS

RELATED APPLICATION

The present application claims the benefit of U.S. Provisional Application No. 61/402,230, filed Aug. 26, 2010, entitled "UTILITY-DRIVEN ENERGY-LOAD MANAGEMENT WITH ADAPTIVE FAN CONTROL DURING LOAD-CONTROL EVENTS", which is incorporated herein in its entirety by reference.

FIELD OF THE INVENTION

The present invention relates generally to utility-driven management of electrical loads. More particularly, the present invention relates to control of circulation fans in a load-managed system for conditioning air and maximizing occupant comfort during a load-control event.

BACKGROUND OF THE INVENTION

To manage electricity usage during times of peak demand, utility companies enroll consumers in load-management, or load-shedding, programs. Participants of load-management programs agree to allow utility companies to reduce their power consumption by controlling operation of the cooling or heating devices of their heating, ventilating, and air-conditioning (HVAC) systems. Control of such devices may be accomplished through the use of a controller integrated into, or cooperating with, a utility meter, thermostat, load-control device, or other such control device. In the case of cooling control, utility companies take control of compressors on some of the hottest days in an attempt to regulate peak demand for electricity.

Utility companies reward their consumers enrolled in such load-management programs with reduced electricity rates, rebates, updated equipment, and so on. These kinds of incentives may be effective in attracting a consumer to a program, but if a consumer's comfort is compromised, the consumer may drop out of the program.

Utility companies respond to this concern in a variety of ways. One way is to place limits on the control parameters. In one example, a utility company promises to limit the temperature rise during any particular control event, for example, four degrees. In another example, a utility company promises consumers not to control their system for more than six hours in any given day. Another more technological approach is to more precisely control the electrical load, for example, by cycling loads for shorter periods of time and allowing temperatures to rise slowly over time.

These top-down, utility-driven solutions, generally applied to residences, focus almost exclusively on control of a single device or load at a facility, namely an air-conditioning compressor or in some cases, a heating element. Further, absolute space temperature, or change in temperature, remains the measure of consumer comfort. Generally, such solutions do not attempt to control the circulation of air during a load control event, and generally neglect the effects that airflow, or lack thereof, may have on consumer comfort.

For example, in a traditional forced-air heating and cooling system, air is heated or cooled and forced through a network of air ducts by a circulation fan. Based upon a temperature set point, a thermostat calls for heating or cooling, and in the case of cooling, causes a compressor to turn on, and the circulation fan to circulate cooled air through the ductwork to various points about the structure, such as rooms in a residence, or offices in a commercial building.

When a load management system is introduced to the forced-air HVAC system, a load-management controller, often integrated into a thermostat, controls operation of the heating or cooling device to reduce energy consumption. With some load management techniques, the temperature set point may be modified, for example, by implementing a slow temperature ramp-up so as to not call for cooling. With other techniques, power to the energy-consuming appliances may be cycled on and off to control both temperature and energy usage.

However, known load-control, or demand-response, thermostats and other load-control devices generally do not take into account control and operation of the circulation fan during a load-control event. The earliest known load-control thermostats simply left the circulation fan off during load control events. In some devices, this is a relatively simple operation, as a circulation fan often tracks operation of an air-conditioning compressor, turning on when the compressor is powered on, and off when the compressor is off. Some later-developed thermostats allowed for a circulation fan to be turned on manually by a consumer via the thermostat.

For example, U.S. Pat. No. 4,382,544, entitled "Energy Management System with Programmable Thermostat" to Stewart ("Stewart") discloses a user-programmable thermostat that controls furnace and air-conditioning units as part of a load-shedding program. Stewart discloses that the thermostat controls temperature through control of the furnace and A/C, but control of the circulation fan is left to the user which may manually turn on the fan during a load-control event if desired. In another example, U.S. Pat. No. 4,345,162, entitled "Method and Apparatus for Power Load Shedding", the circulation fan is simply turned on during a load-control event.

Unlike the top-down, utility-driven solutions described above, some bottom-up, consumer-driven solutions, generally commercial, implement sophisticated control schemes to control more than just the heating and cooling elements of an HVAC system. In such systems, a circulation fan may be treated as just another electrical load to be cycled for energy management purposes, with little or no consideration given to its effect on consumer comfort.

As such, known devices and methods for controlling electrical loads, especially heating and cooling loads of an HVAC system, fail to coordinate control of circulation fans during load-control events, and thereby fail to maximize potential comfort of the consumer.

SUMMARY OF THE INVENTION

Unlike known load-control thermostats and devices, the present invention recognizes and takes advantage of the role that the circulation fan can play in occupant comfort. Although space temperature certainly plays a significant role in the comfort of an occupant in the space being conditioned, the present invention seeks to take advantage of other factors such as humidity, air movement, uniformity of air temperature, and other factors that may be influenced by the operation of a circulation fan as part of the utility-controlled operation of an HVAC system. The present invention seeks to use utility controlled operation of the circulation fan of the HVAC system during a load control event in order to improve the realized comfort of the consumer and occupant of a facility with an HVAC load under control in order to enhance the ability to attain and retain participants in a utility-driven load-control program. If participants consistently perceive that the space they are in is uncomfortable during load-control events, they may determine that the cost of comfort outweighs the cost of energy saved, and subsequently drop out of the program. A further advantage is that the utility may be able to increase the amount of energy controlled, without compromising consumer comfort.

In one embodiment, the present invention comprises an adaptive-fan-control (AFC) communicating thermostat for controlling an electrical load and controlling an HVAC circulation fan during a load-control event. The thermostat interrupts and overrides fan operation according to an occupant-selected fan setting of the thermostat. The thermostat includes a temperature sensor that senses temperature of a space of a facility, the space receiving conditioned air from an HVAC system having an electrical load; an occupant-selectable fan control adapted to permit an occupant of the space to select one of a plurality of occupant-selected fan-control settings, the fan control configured to control operation of the HVAC circulation fan other than during a load-control event; and a controller in communication with the temperature sensor and the occupant-selectable fan control.

The controller includes a transceiver adapted to receive load-control messages over a communications network; means in communication with the transceiver, the temperature sensor, and the fan control for overriding the occupant-selected fan-control setting to operate the fan based on facility conditions, occupant settings, predetermined utility-managed load-control factors, and an override mode, thereby changing operation of the fan during the load-control event and maximizing occupant comfort in the space of the facility.

In another embodiment, the present invention comprises a method of controlling an electrical load of a system for conditioning air using an adaptive-fan control (AFC) communicating thermostat having an occupant-selectable fan control and a controller in communication with a utility receiving load control messages to maximize comfort of an occupant at a facility during a load-control event. The method includes a first step of receiving a load-control command at a controller in communication with a thermostat. The load-control command for initiating a load-control event includes selectively operating the electrical load of the system for conditioning air. A second step includes detecting a space temperature of the facility receiving conditioned air circulated by the fan of the system for conditioning air. A third step includes determining whether the space temperature is above a set point of the thermostat. Finally, a fourth step includes overriding a customer-selected fan setting to control the fan during the load-control event based upon facility conditions, occupant settings, predetermined utility-managed load-control factors, and an override mode.

BRIEF DESCRIPTION OF DRAWINGS

The invention may be more completely understood in consideration of the following detailed description of various embodiments of the invention in connection with the accompanying drawings, in which.

Figure 1:
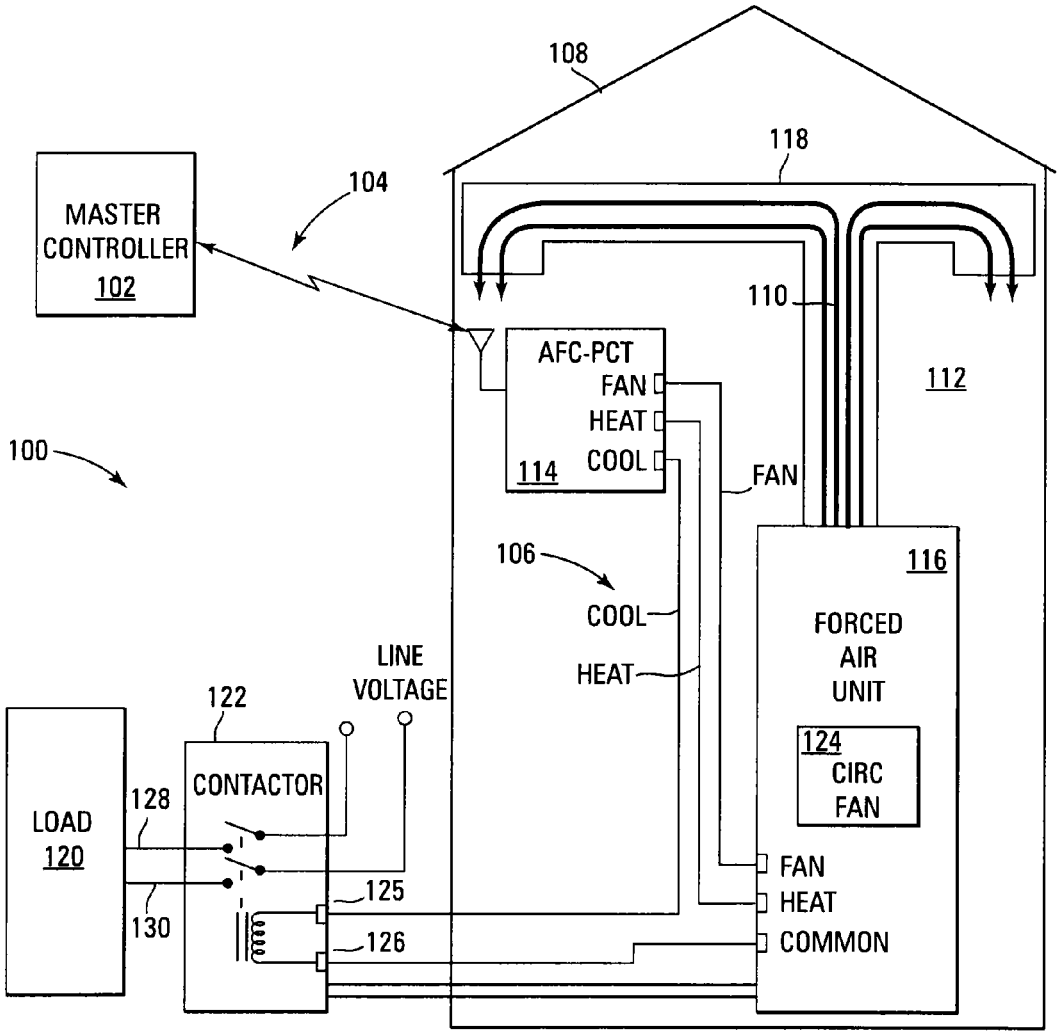
FIG. 1 is a block diagram of an HVAC system that includes an adaptive-fan-control (AFC) communicating thermostat, according to an embodiment of the present invention.

While the invention is amenable to various modifications and alternative forms, specifics thereof have been shown by way of example in the drawings and will be described in detail. It should be understood, however, that the intention is not to limit the invention to the particular embodiments described. On the contrary, the intention is to cover all modifications, equivalents, and alternatives falling within the spirit and scope of the invention as defined by the appended claims.

DETAILED DESCRIPTION

Referring to FIG. 1, adaptive-fan-control (AFC) system 100 includes a remotely-located master controller 102 communicating over communications network 104 with AFC heating, ventilating and air conditioning (HVAC) system 106 at a facility 108.

Master controller 102 may be a controller of a utility company located at a master station, substation, or other location. In one embodiment, the utility company is an electric company providing electricity to a plurality of consumers having AFC-HVAC systems 106, though in other embodiments, the utility company may be a provider of gas or another source of energy.

Communications network 104 in one embodiment is a long-haul communications network facilitating the one-way or two-way transmission of data between master controller 102 and AFC thermostat 114. Data, often in the form of load-control messages or commands, is transmitted using a variety of known wired or wireless communication interfaces and protocols including power line communication (PLC), broadband or other internet communication, radio frequency (RF) communication, and others.

In the depicted embodiment of FIG. 1, communications network 104 is an RF network transmitting and receiving data via radio towers. Network 104 can be implemented with various communication interfaces including, for example, VHF POCSAG paging, FLEX one-way or two-way paging, AERIS/TELEMETRIC Analog Cellular Control Channel two-way communication, SMS Digital two-way communication, or DNP Serial compliant communications for integration with SCADA/EMS communications currently in use by electric generation utilities.

In other embodiments, communications network 104 comprises a wired or wireless short-haul network. In such embodiments, master controller 102 may be a local device such as a smart meter, or other such gateway device that provides message data to AFC thermostat 114 over a relatively short range. Load-control messages may be received over a long-haul network at master controller 102, then transmitted locally over communications network 104 to AFC thermostat 114. In such embodiments, communications network 104 may form a local facility network employing various wireless standards and protocols including Wi-Fi®, ZigBee®, ZigBee Smart Energy Profile®, Blue Tooth®, Z-Wave®, and others.

AFC-HVAC system 106 of facility 108 provides conditioned air 110 for the facility conditioned space 112. Facility 108 may be a residential, commercial, or any other structure requiring conditioned air. Further, facility 108 may have both conditioned and unconditioned spaces. Unconditioned spaces may include attics, crawlspaces, and so on.

AFC-HVAC system 106 in the embodiment depicted includes AFC programmable communicating thermostat (AFC-thermostat) 114, forced air unit (FAU) 116, ductwork 118, load 120, and various electrical lines connecting the components, as described below. In some embodiments, and as depicted in FIG. 1, AFC-HVAC system 106 also includes an electrical switching device, such as a set of contactors 122.

Generally, in addition to its load-control and fan-control capabilities which will be discussed further below, AFC thermostat 114 regulates temperature within conditioned space 112. AFC thermostat 114 may operate on 24VAC, line voltage, or another voltage as needed. AFC thermostat 114 includes electrical terminals $FAN_{TH}$, COOL, and $HEAT_{TH}$, electrically connecting thermostat 114 to corresponding terminals in FAU 116.

Circulation fan 124 in one embodiment may be a single-speed electric fan located within FAU 116, and turned on and off to move air through ductwork 118. In other embodiments, circulation fan 124 may be a variable-speed or adjustable-speed fan controlled to vary the rotation speed of the fan, and hence the air volume output by circulation fan 124.

FAU 116 includes circulation fan 124, and electrical control circuitry having several electrical terminals, including common terminal COMMON, terminal $HEAT_{FAU}$, and terminal $FAN_{FAU}$. FAU 116 may be any of several known types of forced air units used to condition and circulate air. FAU 116 may also include heating and cooling elements, filters, dampers, and other related HVAC equipment not depicted. FAU 116 and circulation fan 124 are connected to ductwork 118 for distributing conditioned air 110 throughout conditioned space 112.

AFC thermostat 114 is electrically connected to FAU 116 through control lines FAN and HEAT. Terminal $FAN_{TH}$ of AFC thermostat 114 is electrically connected to terminal $FAN_{FAU}$ of FAU 116 via control line FAN, and terminal $HEAT_{TH}$ is electrically connected to terminal $HEAT_{FAU}$ of FAU 116 via control line HEAT.

Load 120 comprises an electrically-powered heating or cooling device of a system for conditioning air by heating and/or cooling, such as an HVAC system. Embodiments of cooling loads 120 include compressors or pumps, such as a compressor used in an air-conditioning system, or a compressor used in a heat pump system. Load 120 as depicted in FIG. 1 is an air-conditioning compressor. Embodiments of heating loads also may include compressors or pumps, such as in a heat pump system, or other electrical heating elements used for radiant or electrical resistance heating. Load 120 may be located inside or outside conditioned space 112 of facility 108.

Contactor 122 may be one of many known contactors or other known controlling devices for switching the power to load 120. Contactor 122 includes a pair of control terminals, terminals 125 and 126. Contactor 122 may operate on alternating current (AC) or direct current (DC), and at a control circuit voltage appropriate for the particular control circuit. In one embodiment, a control voltage for contactor 122 may be 24VAC.

Contactor 122 is connected to Line Voltage which, unlike the control voltage at terminals 125 and 126, is typically a higher voltage, alternating voltage source. In one embodiment, Line Voltage is 240VAC. In another embodiment, Line Voltage is 120VAC. It will be understood that Line Voltage may comprise any voltage, current, and frequency appropriate for operating load 120. Contactor 122 is in electrical communication with load 120 through one or more switches, providing power to load 120 via power lines 128 and 130.

In other embodiments, rather than a contactor 122, another form of switching device, such as a relay, for a load such as a compressor, or other electrical load of system 100 may be used. In yet another embodiment, system 106 may not include contactor 122. Control line COOL forms an electrical connection between terminal COOL of AFC thermostat 114 and terminal 125 of contactor 122, such that contactor 122 is in electrical communication with AFC thermostat 114. Terminal 126 may be connected to terminal COMMON of FAU 116, or some other ground or common point.

Figure 2:
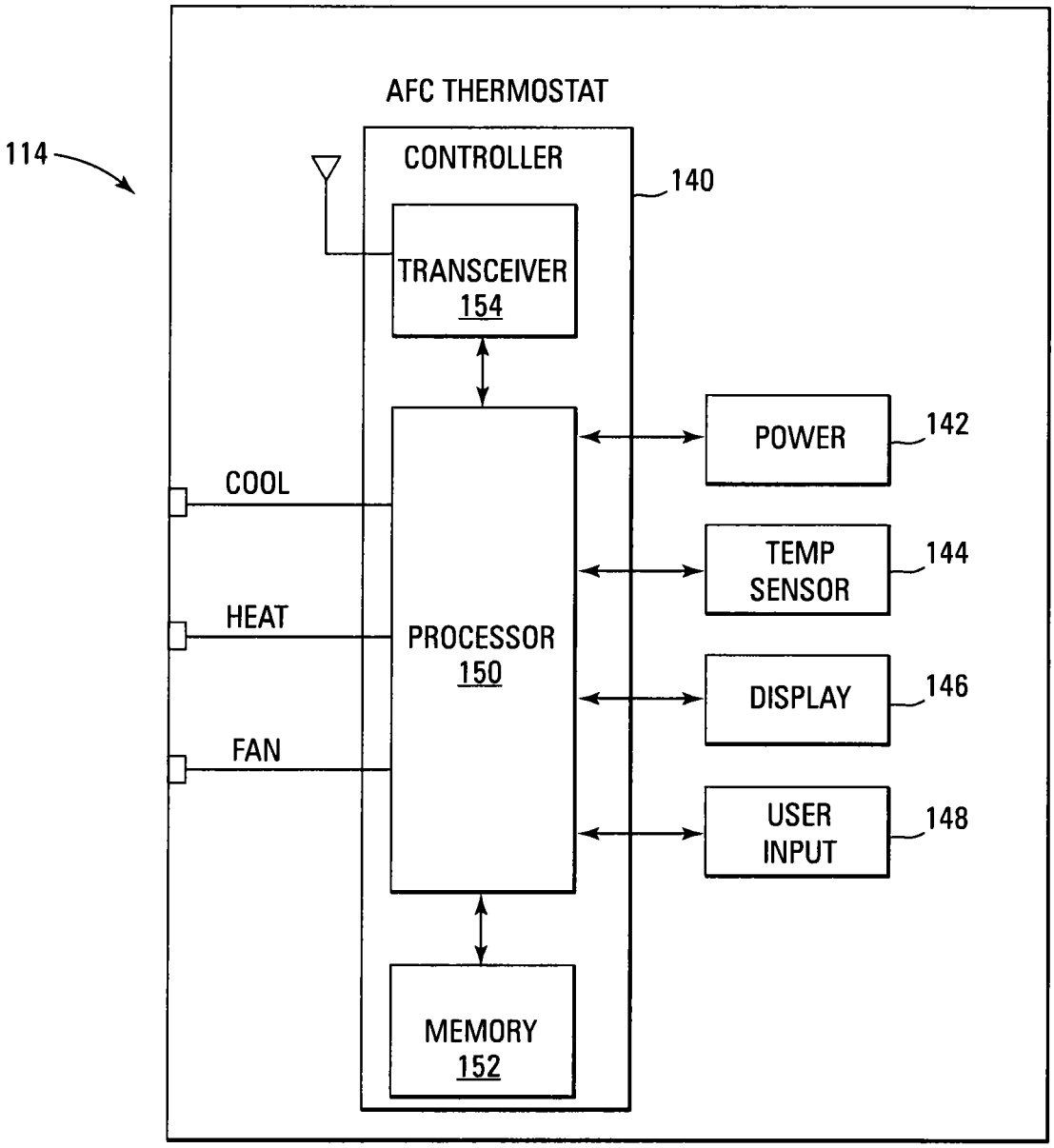
FIG. 2 is a block diagram of an adaptive-fan-control (AFC) communicating thermostat according to an embodiment of the present invention.

Referring to FIG. 2, a block diagram of AFC thermostat 114 is depicted. As will be described further below, AFC thermostat 114 is a communicative thermostat that in one embodiment includes the ability to function as a load-controller, receiving commands controlling operation of load 120. In one embodiment, AFC thermostat 114, includes a controller 140, power circuitry 142, temperature sensor 144, optional display 146, and consumer input 148. Power circuitry 142, temperature sensor 144, display 146 and consumer input 148 are electrically and communicatively coupled to controller 140.

Controller 140 includes one or more processors 150 electrically and communicatively coupled to memory 152 and transceiver 154. Processor 150 includes several control outputs, COOL, $HEAT_{TH}$, and $FAN_{TH}$. In certain embodiments, processor 150 may be a central processing unit, microprocessor, microcontroller, microcomputer, or other such known computer processor. Memory 152 may comprise various types of volatile memory, including RAM, DRAM, SRAM, and so on, as well as non-volatile memory, including ROM, PROM, EPROM, EEPROM, Flash, and so on. Memory 152 may store programs, software, and instructions relating to the operation of AFC thermostat 114.

Transceiver 154, communicatively coupled to processor 150, facilitates receipt and/or transmission of messages over network 104. Transceiver 154 may function as a receiver and a transmitter, or just a receiver. In one embodiment, transceiver 154 is both a receiver and a transmitter, receiving and transmitting data over a two-way communications network 104. In other embodiments, transceiver 154 includes only a receiver, receiving data over a one-way communications network 104. In yet other embodiments, transceiver 154 receives only over network 104, and transmits over an alternate short-haul network. Such a short-haul network might be located at facility 108 and used to facilitate communication between AFC thermostat 114 and load 120, or a device controlling load 120, such as a contactor or relay.

When communications network 104 includes a short-haul network, transceiver 154 in one embodiment may be a stand-alone transceiver chip, such as a ZigBee transceiver chip that includes integrated components, such as a microcontroller and memory, as well as a ZigBee software stack.

In embodiments wherein communications network 104 includes both a short-haul network and a long-haul network, AFC thermostat 114 may include more than one transceiver 154 to facilitate communications between the long-haul and the short-haul network. In embodiments, AFC thermostat 114 may function as a gateway device, in some cases a reconfigurable gateway device, bridging the long-haul and the short-haul network, in a manner similar to the load-control devices as described in U.S. patent application Ser. No. 12/845,506, entitled "Reconfigurable Load-Control Receiver", assigned to the assignees of the present application, and herein incorporated by reference in its entirety.

In some embodiments, wherein communications network 104 is not a radio frequency network, and is a network such as a PLC, DSL, or other such wired network, transceiver 154 may comprise a translation device that serves as a gateway or translator that facilitates communication between master controller 102 and AFC thermostat 114, rather than a traditional RF transceiver.

Power circuitry 142 provides power to devices and components of AFC thermostat 114, and may comprise any combination of alternating or direct current power.

Temperature sensor 144 may be internal or external to AFC thermostat 114, and provides input to controller 140 and processor 150 such that the air temperature of conditioned space 112 may be determined.

Display 146 displays information to a consumer of AFC thermostat 114, such as temperature set point, actual space temperature, time, energy cost, load-control event status, and other such information. In some embodiments, display 146 may be an interactive display, such as a touch-screen display.

Consumer input 148 provides an interface between a consumer and AFC thermostat 114.

In some embodiments, consumer input 148 is a keyboard allowing a use or occupant of facility 108 to input control and other information to AFC thermostat 114, including temperature set point, fan settings, and so on. Input 148 comprises an occupant-selectable fan control that permits a consumer or occupant to select occupant-selectable fan settings, including AUTO, CIRCULATE, ON, and OFF. In other embodiments, consumer input 148 may include portions of display 146, such as when display 146 is a touch-screen display, or one or more switches.

Referring to FIGS. 1 and 2, when load 120 is not being controlled by master controller 102, AFC system 106 operates to autonomously provide conditioned air to space 112 as needed in order to maintain a constant temperature in space 112 as set by the customer via AFC thermostat 114.

In the case where a temperature of space 112 is desired to generally be below an outside air temperature, load 120 is a cooling device, such as an air-conditioning compressor, and AFC system 106 cycles load 120 on and off to cool air 110. More specifically, AFC thermostat 114 senses a temperature of space 112, and when the temperature of space 112 falls below a consumer temperature set point, AFC thermostat 114 calls for cool air by outputting a control signal at terminal COOL. In one embodiment, the control signal is a 24VAC signal.

The output signal of terminal COOL, is received at control terminals 125 and 126 of contactor 122, causing the switches or relays of contactor 122 to close, allowing power to flow to load 120. Load 120 turns on, facilitating cooling of air 110 circulating through FAU 116. In one embodiment, load 120 is an air-conditioning compressor, and during operation, it provides cooled liquid to an evaporator coil within FAU 116, through which air 110 flows.

Similarly, in one such embodiment of system 106 having heating capability, when space 112 requires heating, AFC thermostat 114 outputs a control signal at terminal HEAT, which is received at a heating device, or load, used to heat air 110. Such a heating element may be located within FAU 116 as depicted in FIG. 1, or may be located remote to FAU 116. In an alternate embodiment, load 120 as depicted may be a heating load, and rather than being controlled by terminal COOL of AFC thermostat 114, load 120 is controlled by terminal $HEAT_{TH}$.

With respect to circulation fan 124 operation, AFC 114 outputs a fan control signal at terminal FAN to call for circulation fan 124 to be turned on and off as needed. In one embodiment, an occupant may control circulation fan 124 via an occupant-selectable fan control by selecting from several consumer fan settings, including AUTO, ON, and CIRCULATE.

When load 120 is not being controlled by master controller 102 as described above, if the consumer fan setting is AUTO, circulation fan 124 generally turns on and off with load 120, such that air 110 moved by circulation fan 124 through FAU 116 and ductwork 118 is cooled.

When load 120 is not being controlled by master controller 102, if the consumer fan setting is ON, regardless of whether AFC 114 is calling for cool, and regardless of whether load 120 is operating, circulation fan 124 operates to circulate air throughout space 112. A consumer may prefer to run circulation fan 124 to maximize an amount of fresh air taken into facility 108, to keep a more even temperature throughout space 112, to create a cooling effect due to the movement of air throughout space 112, or for other reasons.

When load 120 is not being controlled by master controller 102, if the occupant fan setting is CIRCULATE, AFC 114 controls circulation fan 124 such that it turns on and off periodically to circulate air throughout space 112. In one embodiment, circulation fan 124 is turned on for a first predetermined period of time, then off for a predetermined period of time, such as 10 minutes on, followed by 20 minutes off. When the fan setting is at CIRCULATE, and load 120 needs to turn on to cool space 112, AFC thermostat 114 will turn on circulation fan 124.

A consumer may choose the CIRCULATE setting to generally circulate more air throughout space 112 than might otherwise be circulated in the case of an AUTO fan setting.

As discussed briefly above, AFC communicating thermostat 114 also operates as a load-control thermostat, sometimes referred to as a demand-response thermostat. To initiate a load-control event, master controller 102 transmits a load-control message over communications network 104 to AFC thermostat 114. Transceiver 154 or AFC thermostat 114 receives the load control message, and communicates the received data to processor 150. Processor 150 may store all or portions of the data in memory 152, depending on the type of load-control message received. For example, load-control messages may include configuration data, or other such commands not directly related to immediately controlling load 120. In addition to such configuration commands, a received load-control message includes commands causing AFC thermostat 114 to take control of load 120. Such features are described further in U.S. Pat. Nos. 7,242,114, and 7,595,567, both entitled "Thermostat Device with Line Under Frequency Detection and Load Shedding Capability", commonly assigned to the assignees of the present application, and herein incorporated in their entireties by reference.

As discussed above, load-control messages may be formatted according to a variety of networking technologies and protocols. In one embodiment, load-control messages may be formatted according to a proprietary protocol, such as an Expresscom® protocol as is described in U.S. Pat. No. 7,702,424 and U.S. Patent Publication No. 2010/0179707, both entitled "Utility Load Control Management Communications Protocol", assigned to the assignees of the present application, and herein incorporated in their entireties by reference.

In one embodiment, in response to a load-control message commanding control of load 120, AFC thermostat 114 controls the operation of load 120 via terminal COOL and contactor 122, according to load-control parameters as established for a load-control event, rather than according to temperature sensor 144 alone. As discussed above, when a load-control event is not occurring, AFC thermostat 114 accepts input from temperature sensor 144, and when the temperature of space 112 rises above a consumer temperature set point, AFC thermostat 114 calls for cool, and load 120 is allowed to operate, thereby cooling air 110. However, during a load-control event designed to conserve energy, load 120 is not allowed to simply turn on when the space temperature rises above an occupant-selected temperature set point, but is selectively operated, e.g., turned on and off, according to the parameters of the particular load-control event.

A number of load-control strategies, alone, or in combination may be employed to control energy usage through control of load 120. One such control strategy is to cycle load 120 based on a duty cycle. Such a "cycling" strategy limits the amount of time that load 120 may operate. In one embodiment, an operational duty cycle for load 120 may be based on a percentage basis, such that load 120 is operational for a given percentage of time during the control event. For example, a 50% duty cycle would allow load 120 to operate up to 50% over a period of time, which may be predetermined.

In more sophisticated cycling strategy embodiments, the amount of time that load 120 may operate may be based on historical usage. In one such embodiment, if a utility desires to reduce the energy usage of loads 120 at facilities 108 by 50%, rather than simply allowing loads 120 to operate up to 50% of the time, historical duty cycles are considered, and loads 120 may be allowed to operate for half the amount of time that they normally would. For example, if historical data indicates that a first load 120 has a duty cycle of 40% when not controlled, and a second load has a duty cycle of 50%, if a utility wishes to reduce the energy usage of the first and second loads by 50%, AFC thermostats 114 may only allow the first load to operate 20% of the time and the second load to operate 25% of the time. Such cycling strategies, as well as other strategies, are described further in U.S. Pat. No. 7,528,503, entitled "Load Shedding Control for Cycled or Variable Load Appliances", assigned to the assignee of the present application, and herein incorporated by reference in its entirety.

In another load-control strategy that may be implemented by AFC thermostat 114, load 120 is cycled on and off based on temperature ramping. With such a strategy, during a load-control event, actual space temperature is allowed to slowly rise above a customer temperature set point. In one embodiment, the temperature of space 112 is allowed to rise a fixed number of degrees above the customer temperature set point over a predetermined period of time. During this temperature rise, load 120 is cycled on and off appropriately so as to allow the temperature to rise above the set point. The ramping, or rate of temperature increase, may vary depending on the degree of energy-savings needed over the particular target period. For example, most residential customers experience an average reduction of 0.9 to 1.2 kW during each hour of control during a standard straight-line ramp. On the other hand, with pre-cool or an accelerated ramp, for example, three or four degrees during an emergency event, a relatively rapid rate may be used.

In some cases, the utility may allow an occupant to select the allowable rise in temperature or pre-cooling to take place prior to a control event. AFC thermostat 114 may also be programmed with randomization in order to slowly bring all loads and controlled devices back on-line and return them to the programmed temperatures following a control event, alleviating the shock to the system of returning all devices simultaneously.

Regardless of the specific control strategy being employed, known demand-response thermostats and other load-control devices generally do not take into account control and operation of the circulation fan during a load-control event.

The earliest known load-control thermostats simply left the circulation fan off during load control events. In some devices, this is a relatively simple operation, as a circulation fan often tracks operation of an air-conditioning compressor, turning on when the compressor is powered on, and off when the compressor is off Some later-developed thermostats allowed for a circulation fan to be turned on manually by a consumer via the thermostat.

However, known load-control thermostats and devices fail to recognize and take advantage of the role that the circulation fan plays in consumer comfort. Although space temperature certainly plays a significant role in the comfort of an occupant in the space being conditioned, other factors such as humidity, air movement, uniformity of air temperature, and other factors that may be influenced by the operation of a circulation fan have so far been substantially ignored.

Maximizing the comfort of the consumer and occupant of a facility with a load under control is crucial to attaining and retaining participants of load-control programs. If participants become uncomfortable during load-control events, many will determine that the cost of comfort outweighs the cost of energy saved, and will subsequently drop out of the program.

AFC communicating thermostat 114 considers the role of the circulation fan during a load-control event, and operates circulation fan 124 to maximize the comfort of occupants at facility 108. In one embodiment, AFC thermostat 114 controls circulation fan 124 during a load-control event based on a number of input parameters, including facility conditions, occupant-settings, utility-managed load-control factors, and an override mode. Facility conditions may include temperature, humidity structural, and other such conditions. Occupant settings include temperature set point, occupant-selected fan settings, and so on. Load-control factors may include the type of load-control event, and other load-event-related factors and conditions.

An occupant-selectable fan control allows an occupant to select a fan setting. In one embodiment, occupant-selectable fan settings may include AUTO, CIRCULATE and ON, as described above with reference to FIG. 2. During normal operation, when a load-control event is not occurring, these occupant-selectable fan settings determine when and whether circulation fan 124 will run. More specifically, when the occupant-selectable fan control setting is set to AUTO, fan 124 circulates air when load 120 operates; when set to CIRCULATE, fan 124 circulates air periodically; and when set to ON, fan 124 circulates air continuously. During a load-control event, AFC thermostat 114 dynamically adapts to override these customer fan settings to operate circulation fan 124 as needed to maximize occupant comfort.

Each AFC Override Mode defines a category of adaptive fan control with particular fan control characteristics. An AFC Override Mode is selected with the goal of maximizing occupant comfort during a load-control event, by optimally controlling operation of circulation fan 124 for any particular facility 108. In one embodiment, AFC Override Modes correspond generally to how much air is allowed to circulate, and to a certain extent, the timing of that air circulation. For example, an AFC Override Mode that minimizes air circulation during a load-control event at a facility 108 in a humid climate might provide optimal occupant comfort at that particular facility 108. On the other hand, an AFC Override Mode that maximizes air circulation during a load-control event at a facility 108 with exceptional insulation and retained cooling capacity might provide optimal occupant comfort for that particular facility 108.

In one embodiment, AFC thermostat 114 includes four AFC Override Modes, AFC-On, AFC-Auto, AFC-Circulate, and AFC-Occupant. The operation of circulation fan 124 during each of these modes depends on factors including occupant fan setting, occupant temperature set point, space temperature, and in some cases whether load 120 is operating during the load-control event. Generally speaking, AFC-On maximizes the amount of air circulated during a load-control event, while AFC-Auto and AFC-Circulate potentially circulates less air than AFC-On. AFC-Occupant turns control of circulation fan 124 over to the occupant by allowing occupant fan settings to determine the operation of circulation fan 124.

As will be discussed further below, the selection of which AFC Override Mode to use depends on a number of geographic, structural, and other considerations affecting the rate of change of air temperature and humidity during a load-control event.

Embodiments of AFC Override Modes of AFC thermostat 114 are described in Tables 1 and 2. Table 1 describes operation of each Mode for a cycling-type load-control event, while Table 2 describes operation during a ramping-type load-control event. Both refer to a cooling load. Although only two types of load-control events are described, it will be understood that AFC Override Modes may be used in a modified or unmodified form with other types of load-control events not described in detail herein.

TABLE 1

Fan Operation During Cycling-Type Load-Control Event

| AFC Override Mode | Space Temperature | Occupant Fan Settings (During Control Event) AUTO | CIRCULATE | ON |
|---|---|---|---|---|
| AFC-On | Below Occupant Set Point | Fan off | Fan circulate | Fan on |
| AFC-On | Above Occupant Set Point | Fan on | Fan on | Fan on |
| AFC-Auto | Below Occupant Set Point | Fan off | Fan circulate | Fan on |
| AFC-Auto | Above Occupant Set Point | Fan off (load off) Fan on (load on) | Fan circulate | Fan on |
| AFC-Circulate | Below Occupant Set Point | Fan Circulate | Fan circulate | Fan circulate |
| AFC-Circulate | Above Occupant Set Point | Fan Circulate | Fan circulate | Fan circulate |
| AFC-Occupant | Below Occupant Set Point | Fan off | Fan circulate | Fan on |
| AFC-Occupant | Above Occupant Set Point | Fan off | Fan circulate | Fan on |

TABLE 2

Fan Operation During Ramping-Type Load-Control Event

| AFC Override Mode | Space Temperature | Customer Fan Settings (During Control Event) AUTO | CIRCULATE | ON |
|---|---|---|---|---|
| AFC-On | Below Occupant Set Point | Fan off | Fan Circulate | Fan on |
| AFC-On | Above Occupant Set Point | Fan on | Fan Circulate | Fan on |
| AFC-Auto | Below Occupant Set Point | Fan off | Fan Circulate | Fan on |
| AFC-Auto | Above Occupant Set Point | Fan on | Fan on | Fan on |
| AFC-Circulate | Below Occupant Set Point | Fan Circulate | Fan Circulate | Fan Circulate |
| AFC-Circulate | Above Occupant Set Point | Fan Circulate | Fan Circulate | Fan Circulate |
| AFC-Occupant | Below Occupant Set Point | Fan off | Fan Circulate | Fan on |
| AFC-Occupant | Above Occupant Set Point | Fan on | Fan on | Fan on |

Referring to both Tables 1 and 2, the operation of circulation fan 124 for each of the AFC Override Modes during cycling-type and ramping-type load -control events, are respectively described. The column labeled "AFC Override Mode" refers to the four different AFC Override Modes employed by AFC thermostat 114 as described above. "Space Temperature" refers to the temperature of space 112 of facility 108, with "Below Occupant Set Point" meaning that the space temperature is at or below the temperature set point as input by the occupant, or otherwise programmed into AFC thermostat 114, and "Above Occupant Set Point" meaning that the space temperature is above the temperature setpoint as input by the occupant. "Occupant Fan Settings" AUTO, CIRCULATE, and ON, refer to the fan settings as input by the occupant into AFC thermostat 114.

With respect to fan operation, in one embodiment, "Fan Off" means that circulation fan 124 is powered off; "Fan Circulate" means that circulation fan 124 is powered periodically to circulate air on and off during the load-control event (as described above with respect to the fan setting "CIRCULATE"); and "Fan On" means that circulation fan 124 is powered on to run continuously throughout the load-control event under the prescribed conditions.

With respect to which AFC Override Mode is most beneficial for a particular facility 108, a number of factors including type of load-control used, geographic location of facility 108, structural characteristics of facility 108, and other such factors may be considered. These factors affecting the choice of Mode will be described below to provide context to the details of Tables 1 and 2, followed by a further description of the tables themselves.

In one embodiment, geographic factors relating to climate, average temperature, humidity, architectural norms, and so on, may drive the initial selection of an AFC Override Mode for AFC thermostat 114. Individual structural factors for various facilities 108, may also be used to determine the optimum AFC Override Mode.

With respect to the geographic factors, in regions with hot climates and high average temperatures, air within space 112 and in ductwork 118 tends to heat up more quickly than in cooler climates due to the larger difference between inside and outside air temperatures. Further, any fresh air drawn in from the outside, tends to be relatively higher temperature air. In such climates, if air is circulated while a cooling load 120 is off, space temperatures may rise rather quickly. Therefore, a higher average temperature tends to favor less air circulation in order to minimize a rise in space temperature, and suggests that an occupant may be more comfortable with less air circulation. In such a case, AFC-ON may be a less favorable Mode, while AFC-Circulate, which provides some circulation and introduction of fresh air, or AFC-Auto, may better maximize occupant comfort.

Another geographic or climatic factor to consider is humidity. When load 120 is a cooling load, as circulated air 110 is cooled, moisture is removed, lowering air humidity. During a load-control event, load 120 will be operating less often such that if air is continuously circulated, humidity of space 112 will tend to rise over time, presumably decreasing the comfort of an occupant in space 112. This factor makes AFC On a less desirable Mode. However, during a load-control event, AFC Auto only allows air to be circulated when load 120 is operated, thus lowering the humidity of the air circulated in space 112, and maximizing the comfort of the occupant. The operation of AFC Auto is similar to the AUTO operation of circulation fan 124 during normal operation, except that in prior-art devices, when a load-control event commences, the AUTO function is typically disabled, and circulation fan is either off or on for the duration of the load-control event.

Another geographic factor, solar gain, tends to favor less air circulation for high solar gain, and more circulation for low solar gain. Sunny regions tend to have high solar gain, causing facilities 108 to heat up more rapidly than regions receiving less sunshine. For example, ultraviolet rays from the sun penetrate windows and raise indoor space 112 temperatures more rapidly in regions receiving more sun, as compared to those with less. High solar gains tend to favor less air circulation during load-control events in order to minimize temperature rises and maximize occupant comfort.

With respect to the architectural norms factor, within a specific geographic region, facilities may be constructed with characteristics particular to the region. Such characteristics may include presence or absences of basements, ductwork in unconditioned spaces such as attics, high or low levels of insulation, and so on. The presence of a basement generally favors circulation of air during load-control events as basements tend to be cooler than above-ground spaces, creating a reservoir of cool air for circulation fan 124 to draw on. Thus, basements, found often in northern regions, generally tend to promote use of AFC On Mode, or AFC circulate to maximize occupant comfort during a load-control event.

On the other hand, facilities 108 in regions without basements, and especially those with ductwork running through unconditioned spaces such as attics, will find more comfort when less air is circulated. For example, in the southwestern region of the United States, many residences do not have basements, and conditioned air is routed through ductworks in an unconditioned attic space. Due to high outdoor temperatures, these attic spaces tend to become relatively hot, causing the temperature of air in the ductwork to rise relatively rapidly if it is circulated continuously during a load-control event. Such a architectural norm would favor AFC Auto or Circulate to offer some air exchange without heating up space 112 temperature too rapidly, as would occur under prior art schemes that constantly operate the circulation fan during a load-control event.

Similarly, high insulation levels, as found in cooler, often northern, regions, promote higher rates of air circulation, while lower insulation levels, as found in warmer regions promote lower rates of air circulation.

The above-discussed geographic factors that affect the choice of AFC Override Mode should not be considered exhaustive, and other geographic factors that affect rates of temperature rise or other quality measures of space 112 during a load-control event may also be considered alone or in combination with the factors above.

In one embodiment, an initial AFC Override Mode is preselected and preprogrammed into AFC thermostat 114, such that upon initial installation, and in response to a load-control event, AFC thermostat 114 operates in the initially selected AFC Override Mode. In an embodiment, a utility company may select an initial AFC Override Mode based on one or more of the geographic factors discussed above, for all facilities 108 in a particular region.

However, in an embodiment, an installer of AFC thermostat 114 may be able to change the initial Mode using a local communications/diagnostics port and a handheld computer, or an occupant may be able to change the AFC Override Mode as needed through user input 148. In other embodiments, the AFC Override Mode may be changed remotely via a load-control message transmitted over network 104. In some embodiments, AFC thermostat 114 may dynamically change its own AFC Override Mode based on historical or other data.

In one embodiment, additional structural factors, or facility factors, of an individual facility 108 may be considered in either selecting the initial Mode, or changing from the initial Mode as selected by the utility. Such structural factors may include factors discussed above with respect to architectural norms, such as the amount of insulation at a particular facility, the length of ductwork in unconditioned spaces, degree of solar gain, due, perhaps, to a large number of windows, and so on. A utility, installer, occupant or otherwise may choose to adjust or change AFC Override Mode should any one of these factors more dominantly affect occupant comfort during a load-control event.

The utility may also adjust the AFC Override Mode setting after some time has passed, and in response to occupant or customer feedback or complaints. In the past, the dissatisfied customer might have dropped out of the energy-saving program due to a real or perceived lack of comfort during a load-control event. However, the ability to adjust Modes based on occupant comfort after installation may assist utilities in retaining such customers that might have otherwise left the program.

Referring to Table 1, when AFC Override Mode "AFC-On" is selected, it is generally assumed that maximum air circulation, within limits, optimizes the comfort of the occupant, due to some combination of the geographic and structural factors discussed above. If an occupant has selected a fan setting of AUTO, when the space temperature is at or below the occupant set point, circulation fan 124 is off, and when the space temperature is above the set point, circulation fan 124 is on, similar to how the AUTO setting works during normal conditions.

With the occupant fan setting is set to CIRCULATE, when the space temperature is at or below the occupant temperature set point circulation fan 124 is allowed to function in a circulate mode during the load-control event, and when the space temperature is above the occupant temperature set point, the fan is on. With this particular combination, occupant comfort is maximized by moving more air as the temperature creeps above the temperature set point.

With the occupant fan setting to ON, circulation fan 124 operates throughout the load-control event, regardless of whether the compressor is running and whether the space temperature is above or below the customer set point.

Still referring to Table 1, when AFC Override Mode is AFC Auto, if an occupant has selected the fan setting ON or CIRCULATE, circulation fan 124 runs continuously, or in circulation mode, respectively. If the Occupant Fan Setting is AUTO, and the space temperature is below the occupant set point, the fan is off, as there is no apparent need to circulate conditioned air. If the Occupant Fan Setting is AUTO, and the space temperature is above the occupant set point, when load 120 is allowed to operate during the load-control event, fan 124 operates to circulate air, but when load 120 is not operating during the load-control event, fan 124 is not operational. In one embodiment, this not only keeps warmed air from circulating, but may aid in keeping humidity levels low by only circulating air that has been conditioned.

When AFC Override Mode is AFC-Circulate, occupant comfort is maximized by having fan 124 running periodically in a circulate mode for all conditions.

When AFC Override Mode is AFC-Occupant, if an occupant of facility 108 feels most comfortable by having fan 124 running constantly or periodically, as indicated by occupant fan settings of ON and CIRCULATE, respectively, these settings are acknowledged, and fan 124 will operate in a fan on or fan circulate mode. However, if an occupant has selected AUTO, circulation fan 124 will remain off during the load control event so as to minimize circulation of potentially discomforting air when load 120 is not operational.

Referring to Table 2, operation of circulation fan 124 during a temperature-ramping-type load control is described. AFC thermostat 114 may adjust its override modes to take into account the differences between load-control schemes, such that AFC Override Modes for use during temperature-ramping-type load-control events is modified somewhat from Modes for cycling-type load control events. As described above, the method of reducing energy usage via a cycling load-control scheme relies on turning off load 124 for periods of time ("off" period of the load control event), and allowing load 120 to turn on as needed during the "on" portion of the load-control event. Generally, operation of fan 124 is based in part on the on/off state of load 120, rather than on the relationship between space temperature and temperature set point. On the other hand, with a temperature-ramping scheme, the temperature set point is ramped up, allowing the space temperature to rise, such that load 120 "naturally" is turned on less often. In this case, cycling of load 120 is dependent upon temperature set point. Consequently, during a load-control event, the overriding of the customer fan-setting is in part tied to the difference in space temperature and temperature set point, rather than whether load 120 is cycling on or off The result is that an occupant has some additional control over fan operation during a ramping-type load-control event. These operational differences are reflected in the tables for AFC-Auto Mode and AFC-Occupant Mode.

First, in AFC-Auto Mode, when a space temperature is above an occupant temperature set point, and the occupant fan setting is AUTO, fan 124 is turned on, rather than turned on and off with load 120. Second, in AFC-Occupant Mode, when the occupant fan setting is AUTO, and the space temperature is above the occupant temperature set point, fan 124 is on, rather than off. Third, also during AFC-Occupant Mode when the space temperature is above the occupant temperature set point, and when the occupant fan setting is CIRCULATE, circulation fan 124 is on.

As such, the ability to adaptively adjust the operation of circulation fan 124 during load-control events based upon conditions including load-control type, occupant fan preferences, actual and desired temperatures, and a variety of geographic and structural characteristics allows AFC communicating thermostat 114 to maximize the comfort of occupants within a conditioned space 112 in a manner that far exceeds the simplistic manual on/off control techniques employed by devices previously known in the art.

The embodiments above are intended to be illustrative and not limiting. Additional embodiments are within the claims. In addition, although aspects of the present invention have been described with reference to particular embodiments, those skilled in the art will recognize that changes can be made in form and detail without departing from the spirit and scope of the invention, as defined by the claims.

Persons of ordinary skill in the relevant arts will recognize that the invention may comprise fewer features than illustrated in any individual embodiment described above. The embodiments described herein are not meant to be an exhaustive presentation of the ways in which the various features of the invention may be combined. Accordingly, the embodiments are not mutually exclusive combinations of features; rather, the invention may comprise a combination of different individual features selected from different individual embodiments, as understood by persons of ordinary skill in the art.

Any incorporation by reference of documents above is limited such that no subject matter is incorporated that is contrary to the explicit disclosure herein. Any incorporation by reference of documents above is further limited such that no claims included in the documents are incorporated by reference herein. Any incorporation by reference of documents above is yet further limited such that any definitions provided in the documents are not incorporated by reference herein unless expressly included herein.

For purposes of interpreting the claims for the present invention, it is expressly intended that the provisions of Section 112, sixth paragraph of 35 U.S.C. are not to be invoked unless the specific terms "means for" or "step for" are recited in a claim.

What is claimed is:

1. An adaptive-fan-control (AFC) communicating thermostat for controlling an electrical load and controlling an HVAC circulation fan during a load control event to interrupt and override fan operation according to an occupant-selected fan setting of the thermostat, the thermostat comprising:

a temperature sensor that senses temperature of a space of a facility, the space receiving conditioned air from an HVAC system having an electrical load;

an occupant-selectable fan control adapted to permit an occupant of the space to select one of a plurality of occupant-selected fan-control settings, the fan control configured to control operation of the HVAC circulation fan other than during a load-control event;

a controller in communication with the temperature sensor and the occupant-selectable fan control, including:

a transceiver adapted to receive load-control messages over a communications network;

means in communication with the transceiver, the temperature sensor, and the fan control for overriding the occupant-selected fan-control setting to operate the fan based on at least one of ductwork location, and ductwork length, and based on at least one of facility conditions, occupant settings, predetermined utility-managed load-control factors, and an override mode thereby changing operation of the fan during the load-control event and maximizing occupant comfort in the space of the facility.

2. The AFC communicating thermostat of claim 1, wherein the facility conditions include a space temperature.

3. The AFC communicating thermostat of claim 1, wherein the facility conditions are selected from a group consisting of space temperature, humidity, degree of facility insulation, solar gain, presence of ductwork in an unconditioned space, and presence of a basement.

4. The AFC communicating thermostat of claim 1, wherein occupant settings include temperature set point and an occupant-selected fan setting.

5. The AFC communicating thermostat of claim 4, wherein the occupant-selected fan-control setting is selected from the group consisting of AUTO, CIRCULATE, and ON, and wherein AUTO causes the HVAC circulation fan to circulate air only when the electrical load is powered on, CIRCULATE causes the HVAC circulation fan to circulate air for a portion of a predetermined period of time, and ON causes the circulation fan to circulate air continuously.

6. The AFC communicating thermostat of claim 1, wherein the predetermined utility-managed load-control factors include a type of the load-control event.

7. The AFC communicating thermostat of claim 6, wherein the type of the load-control event comprises a cycling-type load-control event.

8. The AFC communicating thermostat of claim 6, wherein the type of the load-control event comprises a temperature-ramping-type load-control event.

9. The AFC communicating thermostat of claim 1, wherein the override mode is selected from a group consisting of an on mode, auto mode, circulate mode, and occupant mode.

10. The AFC communicating thermostat of claim 1, wherein the electrical load is an electrical cooling load comprising an air-conditioning compressor.

11. The AFC communicating thermostat of claim 1, wherein the electrical load includes a heating load.

12. The AFC communicating thermostat of claim 1, wherein the communications network includes a long-haul network.

13. The AFC communicating thermostat of claim 12, wherein the long-haul network includes a paging network.

14. The AFC communicating thermostat of claim 1, wherein the communications network includes a short-haul network.

15. The AFC communicating thermostat of claim 14, wherein the short-haul network comprises a ZigBee network.

16. The AFC communicating thermostat of claim 1, further comprising a user input interface and a display.

17. A method of controlling an electrical load of a system for conditioning air using an adaptive-fan control (AFC) communicating thermostat having an occupant-selectable fan control and a controller in communication with a utility receiving load control messages to maximize comfort of an occupant at a facility during a load-control event, the method comprising:

receiving a load-control command at a controller in communication with a thermostat, the load-control command triggering a load-control event that includes selectively operating the electrical load of the system for conditioning air;

detecting a space temperature of the facility receiving conditioned air circulated by the fan of the system for conditioning air;

selectively causing the controller to determine whether the space temperature is above a set point of the thermostat; and selectively causing the controller to override a customer-selected fan setting to control the fan during the load-control event based upon at least one of ductwork location, and ductwork length, and based on at least one of facility conditions, occupant settings, predetermined utility-managed load-control factors, and an override mode.

18. The method of claim 17, wherein selectively operating the electrical load of the system for conditioning air includes cycling an air-conditioning compressor on and off

19. The method of claim 17, wherein selectively operating the electrical load of the system for conditioning air includes ramping up a temperature set point of a facility during the load-control event.

20. The method of claim 17, wherein the facility conditions are selected from a group consisting of space temperature, humidity, degree of facility insulation, solar gain, presence of ductwork in an unconditioned space, and presence of a basement.

21. The method of claim 17, wherein occupant settings include temperature set point and an occupant-selected fan setting.

22. The method of claim 21, wherein the occupant-selected fan-control setting is selected from the group consisting of AUTO, CIRCULATE, and ON, and wherein AUTO causes the HVAC circulation fan to circulate air only when the electrical load is powered on, CIRCULATE causes the HVAC circulation fan to circulate air for a portion of a predetermined period of time, and ON causes the circulation fan to circulate air continuously.

23. The method of claim 17, wherein the override mode is selected from a group consisting of an on mode, auto mode, circulate mode, and occupant mode.

24. The method of claim 17, wherein selectively causing the controller to override a customer-selected fan setting to control the fan during the load control event includes causing the fan to operate in a CIRCULATE setting when an occupant fan-control setting is ON.

25. The method of claim 17, wherein selectively causing the controller to override a customer-selected fan setting to control the fan during the load control event includes causing the fan to be off when an occupant fan-control setting is AUTO.

26. The method of claim 17, wherein selectively causing the controller to override a customer-selected fan setting to control the fan during the load control event includes causing the fan to be on continuously when an occupant fan-control setting is CIRCULATE.

27. An adaptive-fan-control (AFC) communicating thermostat for controlling an electrical load and controlling an HVAC circulation fan during a load control event to interrupt and override fan operation according to an occupant-selected fan setting of the thermostat, the thermostat comprising:

a temperature sensor that senses temperature of a space of a facility, the space receiving conditioned air from an HVAC system having an electrical load;

an occupant-selectable fan control adapted to permit an occupant of the space to select one of a plurality of occupant-selected fan-control settings, the fan control configured to control operation of the HVAC circulation fan other than during a load-control event;

a controller in communication with the temperature sensor and the occupant-selectable fan control, including:

a transceiver adapted to receive load-control messages over a communications network;

a processor in communication with the transceiver, the temperature sensor, and the fan control, the processor adapted to override the occupant-selected fan-control setting to operate the fan based on at least one of ductwork location, and ductwork length, and based on at least one of facility conditions, occupant settings, predetermined utility-managed load-control factors, and an override mode, thereby changing operation of the fan during the load-control event and maximizing occupant comfort in the space of the facility.

28. The AFC communicating thermostat of claim 27, further comprising a user input interface and a display.

29. The AFC communicating thermostat of claim 27, wherein the communications network is a long-haul, radio-frequency communications network.

30. The AFC communicating thermostat of claim 27, wherein the load-control event comprises a cycling-type load-control event and the override mode comprises the on mode, the on mode adapted to cause the HVAC circulation fan to run continuously when:

the temperature sensor senses that the temperature of the space of the facility is above an occupant set point, and an occupant-selected fan-control setting is AUTO, CIRCULATE, or ON.

31. The AFC communicating thermostat of claim 27, wherein the load-control event comprises a temperature-ramping-type load-control event and the override mode comprises the on mode, the on mode adapted to cause the HVAC circulation fan to run continuously when:

the temperature sensor senses that the temperature of the space of the facility is above an occupant set point, and an occupant-selected fan-control setting is ON; or the temperature sensor senses that the temperature of the space of the facility is below an occupant set point, and an occupant-selected fan-control setting is AUTO or ON.

32. The AFC communicating thermostat of claim 27, wherein the override mode comprises the circulate mode, the circulate mode adapted to cause the HVAC circulation fan to circulate air for a portion of a predetermined period of time, when the temperature of the space of the facility is above, below, or at the occupant set point, and the occupant fan-control setting is AUTO, CIRCULATE, or ON.

33. The AFC communicating thermostat of claim 27, wherein the load-control event comprises a temperature-ramping-type load-control event and the override mode comprises the occupant mode, the occupant mode adapted to cause the HVAC circulation fan to run continuously when:

the temperature sensor senses that the temperature of the space of the facility is above an occupant set point, and an occupant-selected fan-control setting is AUTO or CIRCULATE.

* * * * *